US005915552A

United States Patent [19]

Kim et al.

[11] Patent Number: 5,915,552

[45] Date of Patent: Jun. 29, 1999

[54] PAINT ROLLER PROTECTIVE DEVICE

[76] Inventors: Min J. Kim, 1644 4$^{th}$Ave., Los Angeles, Calif. 90019; Do N. You, 330 S. Harvard Blvd., #207, Los Angeles, Calif. 90020

[21] Appl. No.: 09/231,200

[22] Filed: Jan. 14, 1999

[51] Int. Cl.$^{6}$ ..... B65D 81/18

[52] U.S. Cl. ..... 206/361; 206/15.3

[58] Field of Search ..... 206/349, 361, 206/15.2, 15.3, 209; 220/697

[56] References Cited

U.S. PATENT DOCUMENTS

| | | | |
|---|---|---|---|
| D. 285,146 | 8/1986 | Abellira | D4/263 |
| 2,636,252 | 4/1953 | Barnes et al. | 29/120 |
| 4,738,358 | 4/1988 | Kehl | 206/361 X |
| 4,897,893 | 2/1990 | Barker | 15/230.11 |
| 5,178,274 | 1/1993 | Long | 206/361 |
| 5,345,648 | 9/1994 | Graves | 15/230.11 |
| 5,711,047 | 1/1998 | Armaly, Jr. | 15/230.11 |

*Primary Examiner*—Jacob K. Ackun
*Attorney, Agent, or Firm*—John K. Park; Law Offices of John K. Park & Associates

[57] ABSTRACT

A paint roller protective device for a paint roller including a roller portion having a diameter, a handle and a shaft having an inner end connected to the handle and an outer end, the roller portion rotatably mounted on the shaft. The paint roller protective device includes (a) an elongated shell including an end wall, side walls extending from the end wall, an open end for receiving said roller portion, and an inner diameter selected to provide a clearance between the roller portion and the walls of the shell when the roller portion is inserted in the shell; (b) a cap for covering at least a portion of the open end of the shell, the cap including holder means for engaging and holding a portion of said handle when the roller portion is inserted in the shell and the cap is placed over said open end, such that the roller portion remains substantially free of the walls of the shell; and (c) attachment means for detachably attaching the cap to the shell. Further, the shell can have retaining means proximate said open end for engaging and holding a portion of said handle when the roller portion is inserted in the shell and the cap is placed over said open end, such that the roller portion remains substantially free of the walls of the shell, wherein the holder means and the retaining means form a housing for holding a portion of said handle.

27 Claims, 6 Drawing Sheets

PAINT ROLLER PROTECTIVE DEVICE

FIELD OF THE INVENTION

The present invention relate to paint rollers, and in particular, to paint roller protective devices.

BACKGROUND

Paint rollers are utilized for applying paint to various surfaces such as walls. A typical paint roller includes a roller portion, a handle and a shaft having an inner end connected to the handle and an outer end. The roller portion is rotatably mounted on the shaft. The roller can be encased in a cover made of porus fabrics for absorbing paint and discharging the paint upon contact with a surface.

After use, the roller portion must be thoroughly cleaned of paint using water or cleaners. This process is time consuming and requires use of cleaners. Further, cleaning the roller portion is an untidy task, often leading to splashing of paint or paint residue on the surroundings. The paint is toxic, exposure to paint or its vapors can cause serious health risks. After cleaning, the roller portion must then be left to dry freely and without contact with any surface. If the roller portion is left in contact with any surface while drying, the painting surface on the roller portion becomes irregular in shape and surface. Such irregularities cause non-uniform application of paint to surfaces when the roller is later used.

SUMMARY

The present invention provides a paint roller protective device that alleviates the above problems. In one embodiment, the paint roller protective device comprises: (a) an elongated shell including an end wall, side walls extending from the end wall, an open end for receiving said roller portion, and an inner diameter selected to provide a clearance between the roller portion and the walls of the shell when the roller portion is inserted in the shell; (b) a cap for covering at least a portion of the open end of the shell, the cap including holder means for engaging and holding a portion of said handle when the roller portion is inserted in the shell and the cap is placed over said open end, such that the roller portion remains substantially free of the walls of the shell; and (c) attachment means for detachably attaching the cap to the shell.

The holder means can comprise a holding member extending from the cap for engaging and holding at least a portion of said handle when the roller portion is inserted in the shell and the cap is placed over the open end of the shell. The holding member can include an elongated channel having an inner diameter for receiving at least a portion of said handle.

The shell can further comprises retaining means proximate said open end for engaging and holding a portion of said handle when the roller portion is inserted in the shell and the cap is placed over said open end, such that the roller portion remains substantially free of the walls of the shell, wherein the holder means and the retaining means form a housing for holding a portion of said handle. The retaining means can include a retaining member extending from the shell proximate said open end for engaging and holding at least a portion of said handle when the roller portion is inserted in the shell and the cap is placed over the open end of the shell. The retaining member can comprise an elongated channel having an inner diameter for receiving at least a portion of said handle.

The paint roller protective device can further comprise a fastening means including: (a) a lever pivotally attached to an outer surface of the shell proximate said open end; and (b) a hook having a first end attached to said lever, and a substantially curved free end for engaging an outer surface of the cap; wherein, the lever has an open position for allowing the cap to be placed over the open end of the shell and for the free end of the hook to engage the cap, and a closed position for loading the hook to securely hold the cap against the open end of the shell. Further, the closed end of the shell includes a ridge extending into the shell for engaging the outer end of said shaft of the paint roller.

The end wall the shell can include a ridge extending into the shell for engaging the outer end of said shaft of the paint roller to maintain the roller portion free from the inner walls of the shell. Further, the end wall of the shell can comprise an end cap detachably attached to the shell.

In another embodiment, a paint roller protective device according to the present invention comprises: (a) an elongated shell including an end wall, side walls extending from the end wall, an open end for receiving said roller portion, an inner diameter selected to provide a clearance between the roller portion and the walls of the shell when the roller portion is inserted in the shell, and retaining means proximate said open end for engaging and holding a portion of said handle when the roller portion is inserted in the shell such that the roller portion remains substantially free of the walls of the shell; (b) a cap for covering at least a portion of the open end of the shell; and (c) attachment means for detachably attaching the cap to the shell.

The retaining means can comprise a retaining member extending from the shell for engaging and holding at least a portion of said handle when the roller portion is inserted in the shell and the cap is placed over the open end of the shell. The retaining member can include an elongated channel having an inner diameter for receiving at least a portion of said handle. Further, the cap can further comprise holder means for engaging and holding a portion of said handle when the roller portion is inserted in the shell and the cap is placed over said open end, such that the roller portion remains substantially free of the walls of the shell. The holder means can comprise a member extending from the cap for engaging and holding at least a portion of said handle when the roller portion is inserted in the shell and the cap is placed over the open end of the shell. The holder means can comprise an elongated channel having an inner diameter for receiving at least a portion of said handle, wherein when the cap is placed over said open end, the holder means and the retaining means form a housing for holding a portion of said handle.

DRAWINGS

These and other features, aspects and advantages of the present invention will become better understood with regard to the following description, appended claims and accompanying drawings where:

DESCRIPTION

Figure 1:
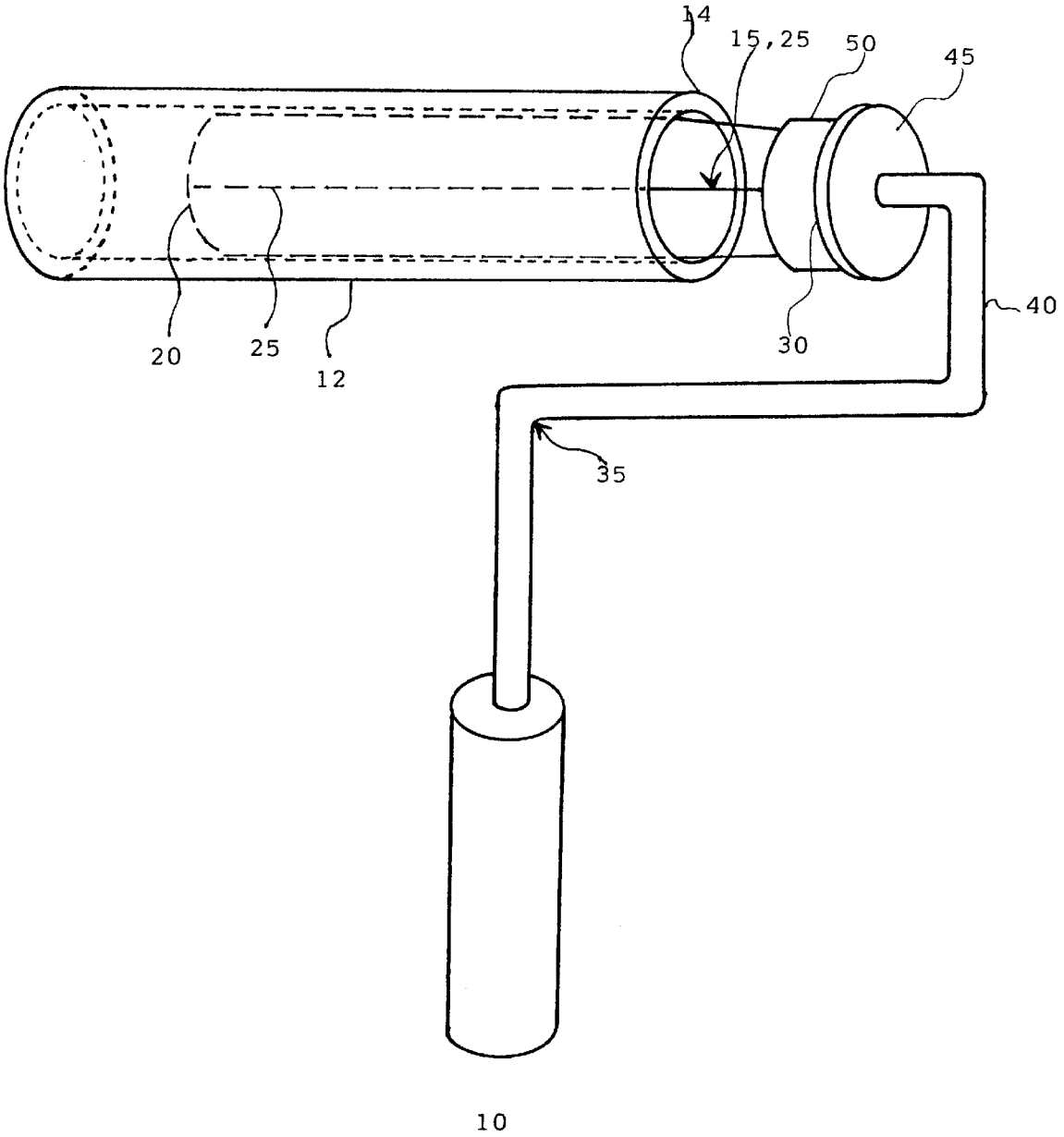
FIG. 1 is a plan view of a typical paint roller.
Figure 2:
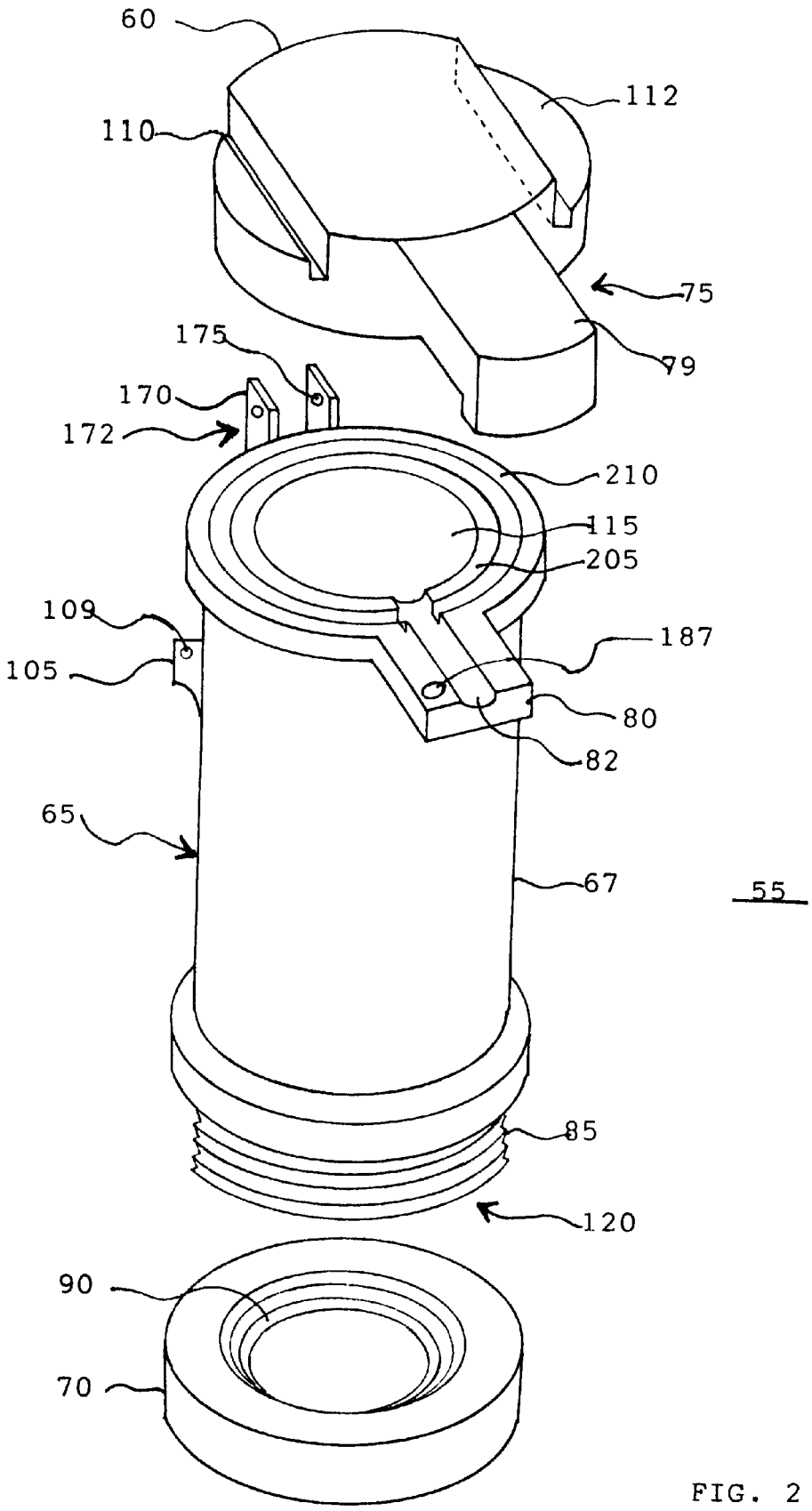
FIG. 2 is an exploded perspective view on an embodiment of a paint roller protective device according to the present invention.

The present invention provides a paint roller protective device for paint rollers such as a paint roller 10 shown in FIG. 1. The paint roller 10 comprises a roller portion 12 having a diameter, a handle 35 and a shaft 15 having an inner end 30 connected to the handle 35 and an outer end 20, the roller portion 12 rotatably mounted on the shaft 15. The roller portion 12 can have a cover 14, a length of about 9 inches and a diameter of about 1.44 inches. The handle 35 can have a length of about 9 inches.

Referring to FIG. 2, 3, 4 and 5, an embodiment of a paint roller protective device 55 according to the present invention comprises: (a) an elongated shell 65 including an end wall 72, side walls 67 extending from the end wall 72, an open end 115 for receiving said roller portion 12, and an inner diameter selected to provide a clearance between the roller portion 12 and the walls 67 of the shell 65 when the roller portion 12 is inserted in the shell 65; (b) a cap 60 for covering at least a portion of the open end 115 of the shell 65, the cap 60 including holder means 75 for engaging and holding a portion 40 of said handle 35 when the roller portion 12 is inserted in the shell 65 and the cap 60 is placed over said open end 115, such that the roller portion 12 remains substantially free of the walls 67 of the shell 65; and (c) attachment means comprising a hinge 172 for detachably attaching the cap 60 to the shell 65. Other attachment means are also possible.

As such, the roller portion 12 and the cover 14 are not in contact with the walls 67 of the shell 65. Therefore, the painting surface of the cover 14 of the roller portion 12 does not become irregular in shape and surface. This prevents irregularities in the surface of the cover 14, and application of paint to surfaces when the roller 10 is later used is uniform. Further, the protective device 55 provides for extended storage of the paint roller 10 therein while protecting the paint roller portion 12 as described above. The protective device 55 further protects at least a portion of the handle 35 of the paint roller 10.

Figure 6:
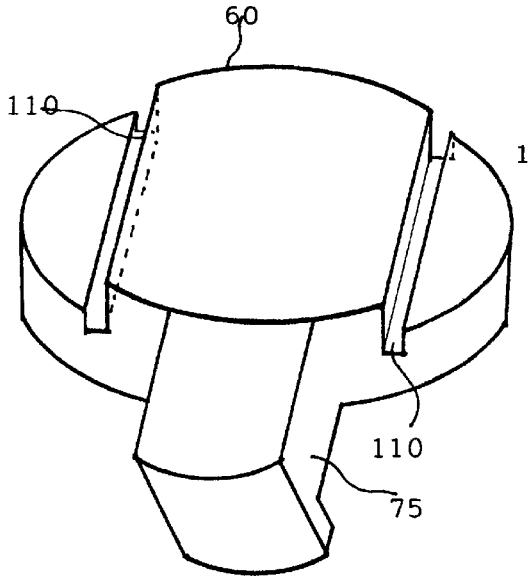
FIG. 6 is a perspective view of one side of an embodiment the cap for the open end of the paint roller protective device of FIG. 2.
Figure 7:
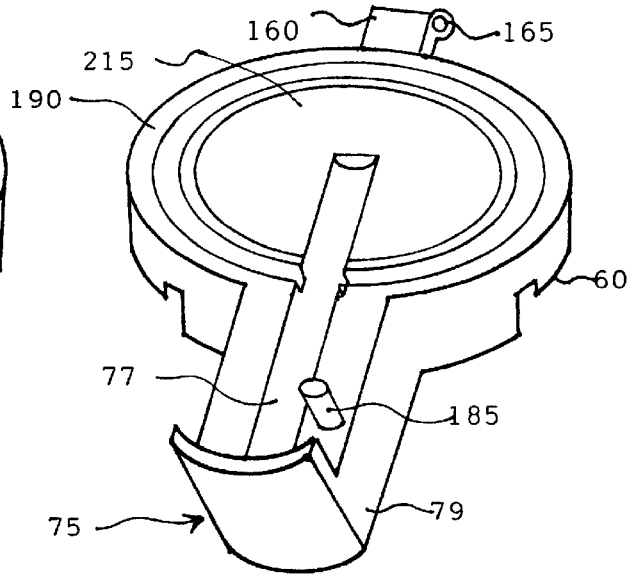
FIG. 7 is a perspective view of another side of the cap of FIG. 6.

The shell 65 is substantially cylindrical in shape having a length of about 11 inches and an inner diameter of about 1.55 inches or greater to provide a clearance of about 0.11 inches or more between the walls 67 and the roller portion 12, when the roller portion 12 is inserted in the shell 65. Other shapes for the shell 65 are also possible. The shell 65 includes a collar 210 forming said opening 115. Referring to FIGS. 6 and 7, the cap 60 includes a circular wall 215 and a collar 190 of same diameter as collar 210 of the shell 65. The hinge 172 comprises a member 160 extending from the cap 60, and a pair of spaced members 170 extending from the shell 65 proximate said opening 115. The member 160 includes an opening 165, and the spaced members 170 include openings 175, whereby the first and the second members 160 and 170 can be rotatably attached by placing the member 160 between the spaced members 170, aligning the openings 165, 175 and inserting a pin therethrough. To place the cap 60 over the opening 115, the cap 60 is rotated toward the opening 60, such that the collar 190 of the cap 60 is placed against the collar 210 of the shell 65.

The holder means 75 comprises a holding member 79 extending from the cap 60 for engaging and holding at least the portion 40 of the handle 35 when the roller portion 12 is inserted in the shell 65 and the cap 60 is placed over the open end 115 of the shell 65. The holding member 79 includes an elongated channel 77 having an inner diameter for receiving said portion 40 of the handle 35. Other holder means are also possible.

The shell 65 can further comprise retaining means proximate said open end 115 for engaging and holding the portion 40 of the handle 35 when the roller portion 12 is inserted in the shell 65 and the cap 60 is placed over said open end 115, such that the roller portion 12 remains substantially free of the walls 67 of the shell 65. The retaining means comprises a retaining member 80 extending from the shell 65 proximate said open end 115 for engaging and holding the portion 40 of the handle 35 when the roller portion 12 is inserted in the shell 65 and the cap 60 is placed over the open end 115 of the shell 65. The retaining member 80 comprises an elongated channel 82 having an inner depth diameter for receiving said potion 40 of the handle 35. As such, the holder member 79 and the retaining member 80 form a housing around the handle portion 40 of the handle 35, wherein the handle portion 40 is held securely therebetween. The handle portion is cylindrical in shape with a length of about 3.75 inches and a diameter of about 0.31 inches. Each of the channels 82 and 77 is semi-circular in depth with a diameter of about 0.32 inches. The shape and sizes of the channels 82 and 87 should preferably correspond to the shape and size of the handle portion 40 for a secure hold.

The holder member 79 can further include a ridge 185, and the retaining member 80 can further include a notch 187 for receiving said ridge 185, thereby keeping the collar 190 of the cap 60 aligned against the collar 210 of the shell 65. The collar 210 can further include an inner rim 205 having a diameter for receiving and cooperatively engaging at least a portion 50 a support flange 45 of the paint roller 10. The portion 50 of the flange 45 can be supported by the rim 205, helping maintain the roller portion 12 free from the walls 67 of the shell 65 when the roller portion 12 is inserted in the shell 65. The cooperative action of the flange portion 50 and the rim 205 can further provide a sealing action, preventing liquids from leaking out of the shell 65 when the roller portion 12 is placed in the shell 65.

The paint roller protective device 55 further comprises fastening means 179 for securely holding the cap 60 against the shell 65. The fastening means 179 comprises a lever 125 pivotally attached to a ridge 105 extending from the wall 67 the shell 65 proximate said open end 115. The ridge 105 has an opening 109, and a split ends 95 of the lever 125 has openings 100, whereby the lever 125 can be rotatably attached to the ridge 105 by placing the ridge 105 between the split end 95, aligning the openings 109 and 100, and inserting a pin therethrough.

Figure 3:
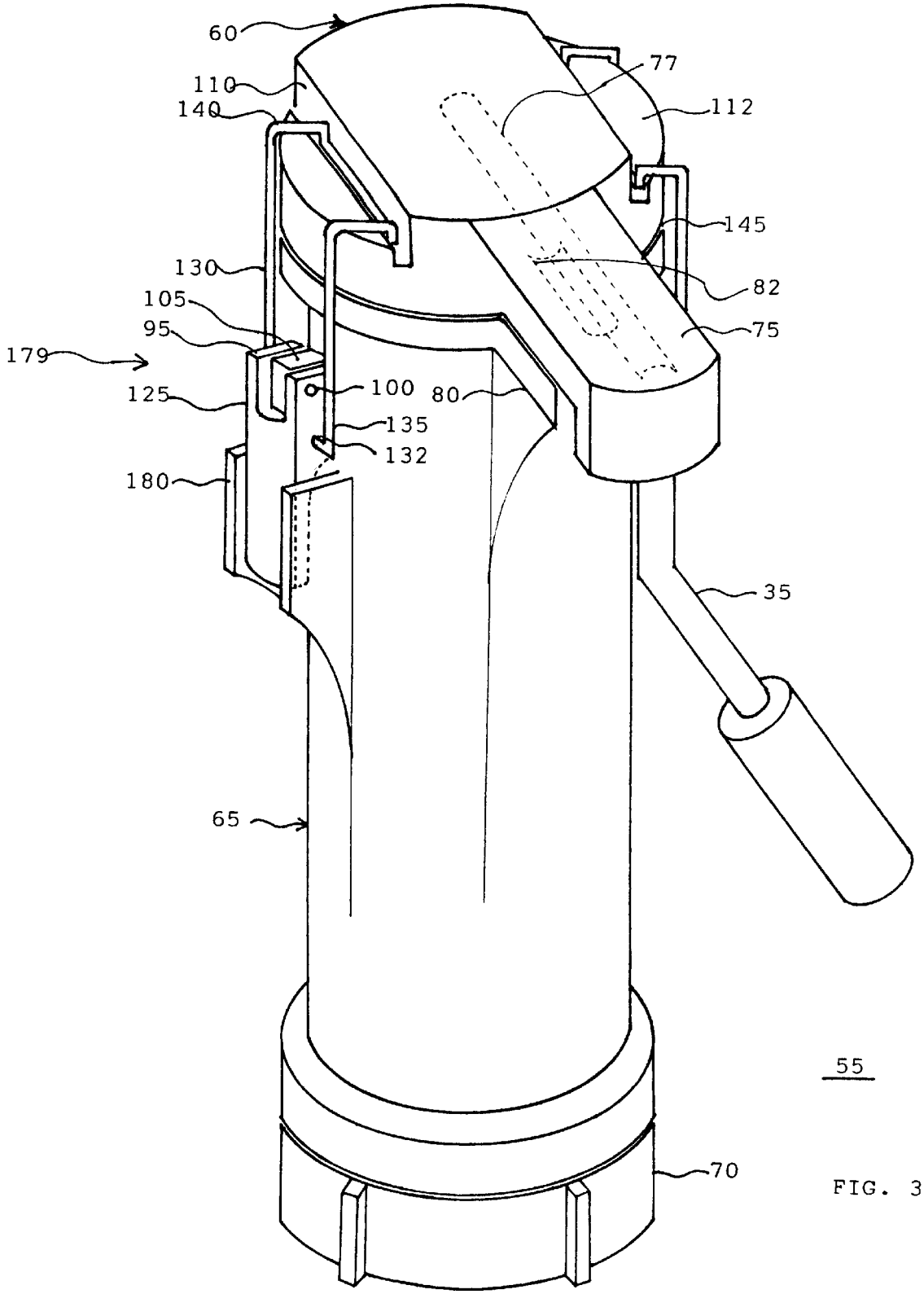
FIG. 3 is a perspective view of the paint roller protective device of FIG. 2 assembled, with a paint roller stored therein.
Figure 4:
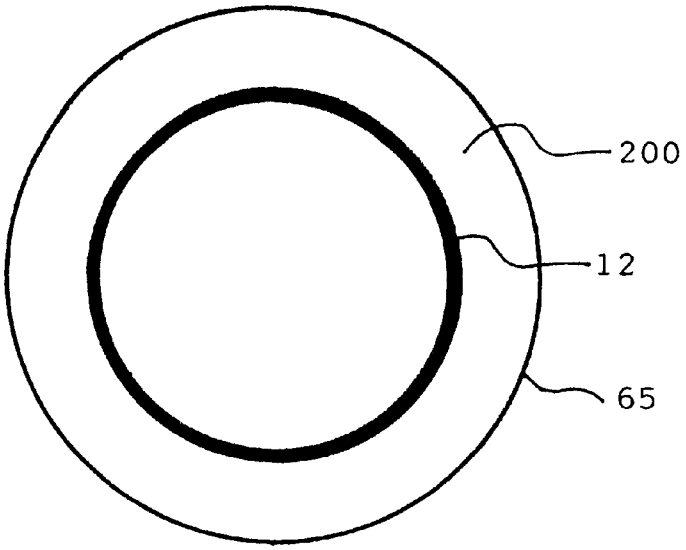
FIG. 4 is a cross section view of the paint roller protective device and paint roller of FIG. 3.
Figure 5:
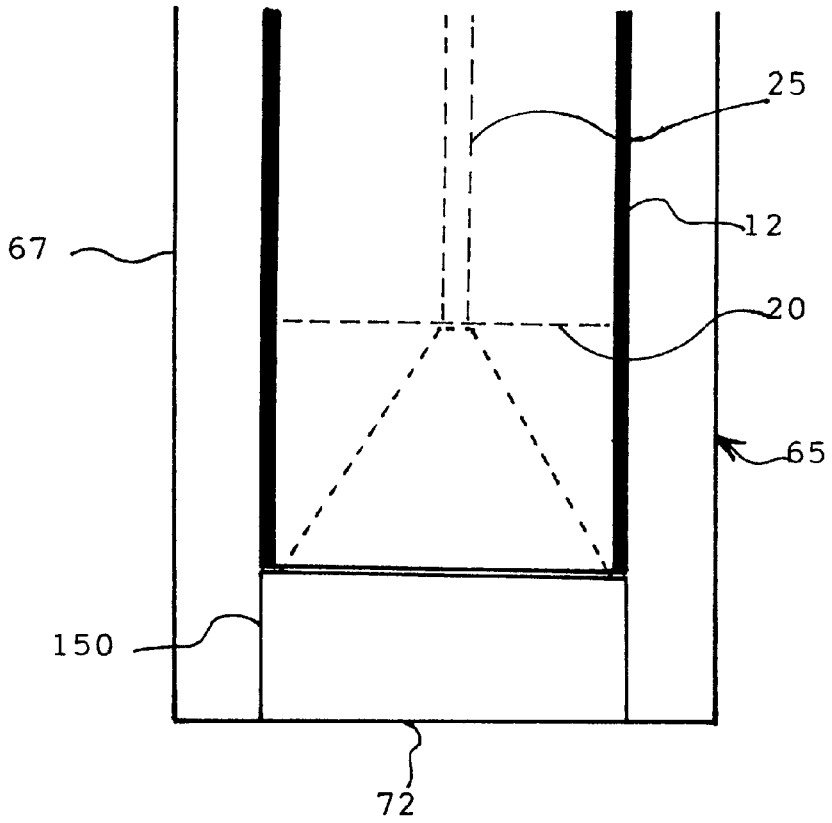
FIG. 5 is a partial view of another cross section of the paint roller protective device and the paint roller of FIG. 3.

The fastening means 179 further comprises a hook 130 having a first end 135 rotatably inserted in an opening 137 in said lever 125, and a substantially curved free end 140 for engaging an outer surface 110 of the cap 60. The lever 125 has an open position, where the lever 125 is rotated away from the wall 67 of the shell 65, thereby unloading the hook 130, allowing the cap 60 to be placed over the open end 115 of the shell 65 and for the free end 140 of the hook 130 to engage the cap 60. To place the lever 125 in a closed position, the free end 140 of the hook 130 is engaged to a groove 110 on the cap 60 and the lever 125 is rotated toward and over the wall 67 of the shell 65, thereby loading the hook 130 to urge the free end 140 of the hook 130 against the groove 110 on the cap 60, and securely holding the cap 60 against the open end 115 of the shell 65 as shown in FIG. 3. The hook can be made from a resilient or rigid material. Other fastening means are also possible.

The paint roller protective device 55 can further comprise a second fastener means similar to the first fastener means 179 described above, and positioned on the walls 67 of the shell 65 opposite the first fastener means 179, for engaging a second groove 112 on the cap 60 to more securely hold the cap 60 against the open end 115 of the shell 65. Preferably, the shell 65 further comprises a pair of spaced protective ridges 180 extending from the walls 67 to receive the lever 125 therebetween in the closed position. The protective ridges 180 help prevent accidental impact on the lever 125 and placing the lever 125 from the closed position to the open position.

Figure 8:
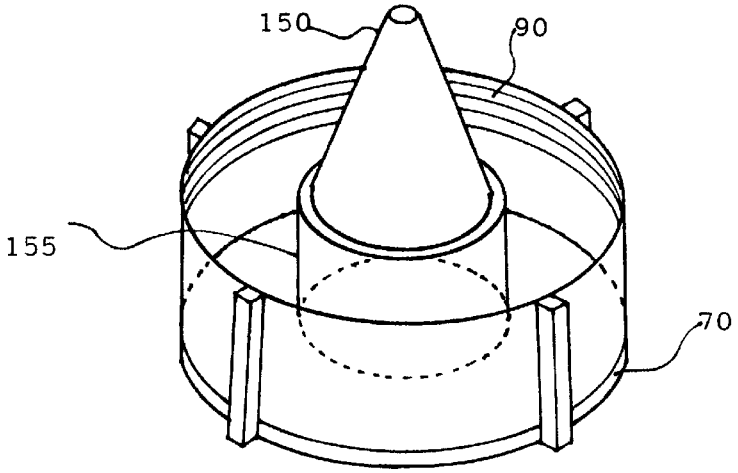
FIG. 8 is a perspective view of an embodiment of the end cap for the paint roller protective device of FIG. 2.

The end wall 72 of the shell 65 can include a ridge 150 extending into the shell 65 for engaging the outer end 20 of said shaft 25 of the paint roller 10, to help maintain the roller portion 12 free from the walls 67 of the shell 65 when the roller portion 12 is inserted in the shell 65. The shell 65 can include a second open end 120, and the end wall of the shell can comprise an end cap 70, attached to the shell 65 to cover the opening 120. The end cap 70 includes threads 90 for cooperative engaging threads 85 on the walls 67 of the shell proximate the opening 120, for threadedly attaching the end cap 70 to the shell 65. Other means of attaching the end cap 70 to the shell 65 are also possible. Referring to FIG. 8, the end cap 70 can include ridge 150 extending into the shell 65 for engaging the outer end 20 of said shaft 25 of the paint roller 10, to help maintain the roller portion 12 free from the walls 67 of the shell 65 when the roller portion 12 is inserted in the shell 65. The ridge 150 can include a base 155, and is shaped to cooperate with the shape of a distal end 25 of the roller portion 12. The shell 65 and the caps 60 and 70 can be made from rigid or resilient materials such as metals or plastics.

Figure 9:
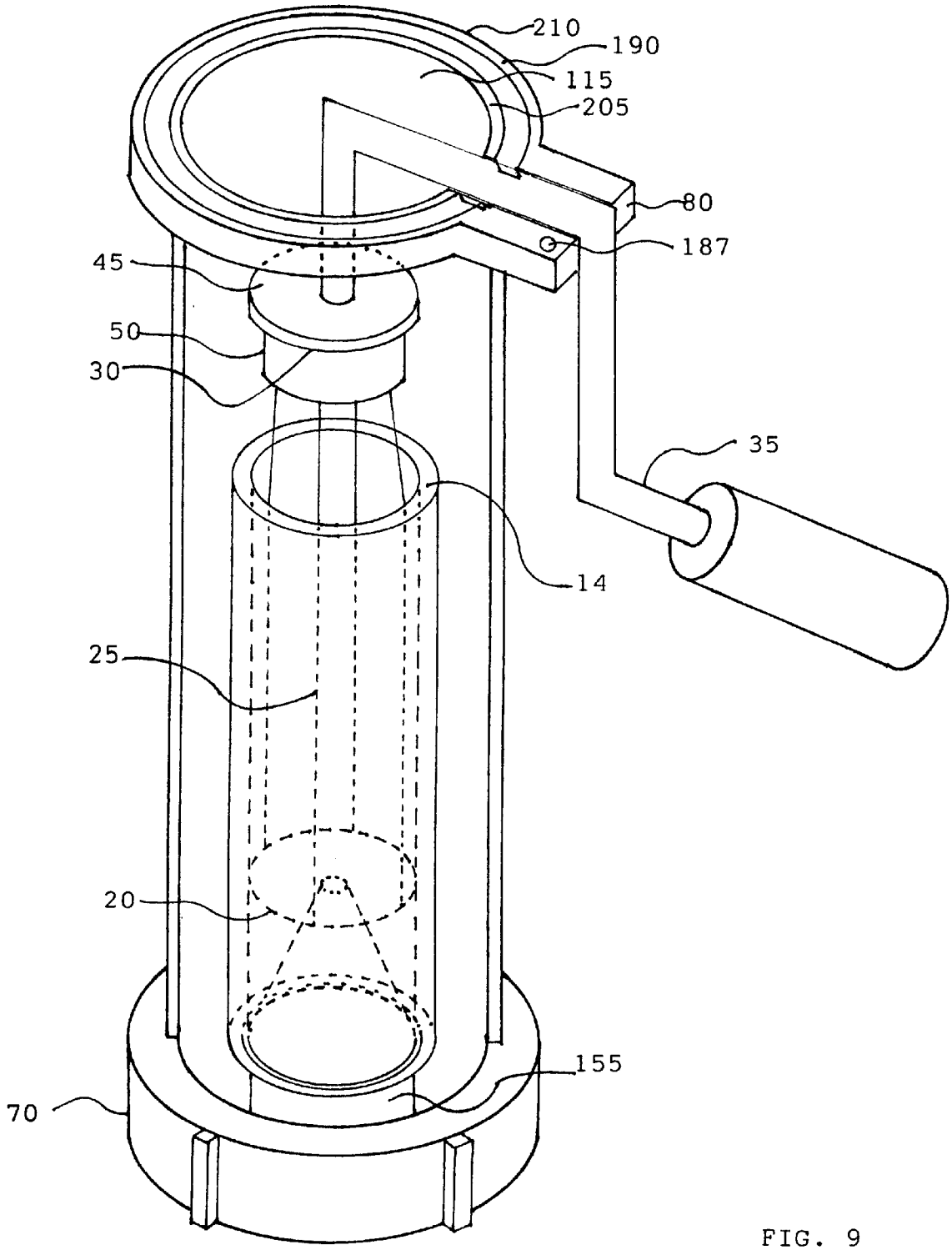
FIG. 9 is a partial cut-away perspective view of an embodiment of a paint roller protective device according to the present invention with the cap for the open end detached.

FIG. 9 shows a partial cut-away perspective view of an embodiment of a paint roller protective device 55 according to the present invention with the cap 60 for the open end 115 detached. In this embodiment, the end cap 70 includes the ridge 150, and is attached to the second open end 120 of the shell 65. When the roller portion 12 is inserted in the shell 65, a portion of the roller cover 14 is shifted onto a portion of the ridge 150 as shown in FIG. 9.

The present invention can be used with or without fresh paint thinner or water as a storing medium to store the paint roller 10 in the shell 65. The selection of the paint thinner or water should be according to the type of paint used. The preferred method is to store the paint roller 10 in the shell 65 with the paint thinner or water.

Also, the current description contains the cover 14 pushed down onto and over the ridge 150 to partially cover the ridge 150. This configuration provides preferred method. However, the cover 14 does not need to be pushed down and over the ridge 150 for this invention to be effective, and this configuration is within the scope of the claims.

Although the present invention has been described in considerable detail with regard to the preferred versions thereof, other versions are possible. For example, the aforementioned dimensions for the paint roller 10 and the paint roller protective device 55 are only one possible instance of many possible dimensions. The protective device 55 can be sized according to the size a paint roller 10 to be covered therewith. Therefore, the appended claims should not be limited to the descriptions of the preferred versions contained herein.

What is claimed is:

1. A paint roller protective device for a paint roller comprising a roller portion having a diameter, a handle and a shaft having an inner end connected to the handle and an outer end, the roller portion rotatably mounted on the shaft, the paint roller protective device comprising:

(a) an elongated shell including an end wall, side walls extending from the end wall, an open end for receiving said roller portion, and an inner diameter selected to provide a clearance between the roller portion and the walls of the shell when the roller portion is inserted in the shell;

(b) a cap for covering at least a portion of the open end of the shell, the cap including holder means for engaging and holding a portion of said handle when the roller portion is inserted in the shell and the cap is placed over said open end, such that the roller portion remains substantially free of the walls of the shell; and (c) attachment means for detachably attaching the cap to the shell.

2. The paint roller protective device of claim 1, wherein the holder means comprises a holding member extending from the cap for engaging and holding at least a portion of said handle when the roller portion is inserted in the shell and the cap is placed over the open end of the shell.

3. The paint roller protective device of claim 2, wherein the holding member comprises an elongated channel having an inner diameter for receiving at least a portion of said handle.

4. The paint roller protective device of claim 2, wherein the shell further comprises retaining means proximate said open end for engaging and holding a portion of said handle when the roller portion is inserted in the shell and the cap is placed over said open end, such that the roller portion remains substantially free of the walls of the shell, wherein the holder means and the retaining means form a housing for holding a portion of said handle.

5. The paint roller protective device of claim 4, wherein the retaining means comprises a retaining member extending from the shell proximate said open end for engaging and holding at least a portion of said handle when the roller portion is inserted in the shell and the cap is placed over the open end of the shell.

6. The paint roller protective device of claim 5, wherein the retaining member comprises an elongated channel having an inner diameter for receiving at least a portion of said handle.

7. The paint roller protective device of claim 1 further comprising fastening means including:

(a) a lever pivotally attached to a wall of the shell proximate said open end; and (b) a hook having a first end attached to said lever, and a substantially curved free end for engaging an outer surface of the cap;

wherein, the lever has an open position for allowing the cap to be placed over the open end of the shell and for the free end of the hook to engage the cap, and a closed position for loading the hook to securely hold the cap against the open end of the shell.

8. The paint roller protective device of claim 1, wherein the attachment means comprises a hinge having a first end attached to a wall of the shell proximate said open end, and a second end attached to the cap.

9. The paint roller protective device of claim 1, wherein the attachment means comprises a fastener for securely holding the cap against the open end of the shell.

10. The paint roller protective device of claim 1, wherein the end wall the shell includes a ridge extending into the shell for engaging the outer end of said shaft of the paint roller to maintain the roller portion free from the inner walls of the shell.

11. The paint roller protective device of claim 1, wherein the end wall of the shell comprises an end cap detachably attached to the shell.

12. The paint roller protective device of claim 11, wherein the end cap includes a ridge extending into the shell for engaging the outer end of said shaft of the paint roller to maintain the roller portion free from the inner walls of the shell.

13. The paint roller protective device of claim 11, wherein the end cap is threadedly attached to the shell.

14. A paint roller protective device for a paint roller comprising a roller portion having a diameter, a handle and a shaft having an inner end connected to the handle and an outer end, the roller portion rotatably mounted on the shaft, the paint roller protective device comprising:

(a) an elongated shell including:

(1) an end wall, (2) side walls extending from the end wall, (3) an open end for receiving said roller portion, (4) an inner diameter selected to provide a clearance between the roller portion and the walls of the shell when the roller portion is inserted in the shell, and (5) retaining means proximate said open end for engaging and holding a portion of said handle when the roller portion is inserted in the shell such that the roller portion remains substantially free of the walls of the shell;

(b) a cap for covering at least a portion of the open end of the shell; and (c) attachment means for detachably attaching the cap to the shell.

15. The paint roller protective device of claim 14, wherein the retaining means comprises a retaining member extending from the shell for engaging and holding at least a portion of said handle when the roller portion is inserted in the shell and the cap is placed over the open end of the shell.

16. The paint roller protective device of claim 15, wherein the retaining member comprises an elongated channel having an inner diameter for receiving at least a portion of said handle.

17. The paint roller protective device of claim 14, wherein the cap further comprises holder means for engaging and holding a portion of said handle when the roller portion is inserted in the shell and the cap is placed over said open end, such that the roller portion remains substantially free of the walls of the shell.

18. The paint roller protective device of claim 17, wherein the holder means comprises a holding member extending from the cap for engaging and holding at least a portion of said handle when the roller portion is inserted in the shell and the cap is placed over the open end of the shell.

19. The paint roller protective device of claim 18, wherein the holding member comprises an elongated channel having an inner diameter for receiving at least a portion of said handle.

20. The paint roller protective device of claim 17, wherein when the cap is placed over said open end, the holder means and the retaining means form a housing for holding a portion of said handle.

21. The paint roller protective device of claim 14 further comprising fastening means including:

(a) a lever pivotally attached to a wall of the shell proximate said open end; and (b) a hook having a first end attached to said lever, and a substantially curved free end for engaging an outer surface of the cap;

wherein, the lever has an open position for allowing the cap to be placed over the open end of the shell and for the free end of the hook to engage the cap, and a closed position for loading the hook to securely hold the cap against the open end of is the shell.

22. The paint roller protective device of claim 14, wherein the attachment means comprises a hinge having a first end attached to an outer surface of the shell proximate said open end, and a second end attached to the cap.

23. The paint roller protective device of claim 14, wherein the attachment means comprises a fastener for securely holding the cap against the open end of the shell.

24. The paint roller protective device of claim 14, wherein the end wall the shell includes a ridge extending into the shell for engaging the outer end of said shaft of the paint roller to maintain the roller portion free from the inner walls of the shell.

25. The paint roller protective device of claim 14, wherein the end wall of the shell comprises an end cap detachably attached to the shell.

26. The paint roller protective device of claim 25, wherein the end cap includes a ridge extending into the shell for engaging the outer end of said shaft of the paint roller to maintain the roller portion free from the inner walls of the shell.

27. The paint roller protective device of claim 25, wherein the end cap is threadedly attached to the shell.

* * * * *